US009966175B2

(12) United States Patent
Wakai et al.

(10) Patent No.: US 9,966,175 B2
(45) Date of Patent: May 8, 2018

(54) SOLENOID DRIVE DEVICE

(71) Applicant: KEIHIN CORPORATION, Tokyo (JP)

(72) Inventors: Motoshi Wakai, Utsunomiya (JP); Masaya Kimura, Moka (JP)

(73) Assignee: KEIHIN CORPORATION, Tokyo (JP)

( * ) Notice: Subject to any disclaimer, the term of this patent is extended or adjusted under 35 U.S.C. 154(b) by 193 days.

(21) Appl. No.: 15/019,482

(22) Filed: Feb. 9, 2016

(65) Prior Publication Data

US 2016/0240299 A1 Aug. 18, 2016

(30) Foreign Application Priority Data

Feb. 13, 2015 (JP) ..... 2015-025914

(51) Int. Cl.
*H01H 47/00* (2006.01)
*H01F 7/06* (2006.01)
*F02D 41/20* (2006.01)

(52) U.S. Cl.
CPC ..... *H01F 7/064* (2013.01); *F02D 41/20* (2013.01); *F02D 2041/2003* (2013.01); *F02D 2041/2013* (2013.01); *F02D 2041/2048* (2013.01)

(58) Field of Classification Search
CPC ..... H01F 7/064
USPC ..... 361/160
See application file for complete search history.

(56) References Cited

U.S. PATENT DOCUMENTS 4,486,703 A * 12/1984 Henrich ..... F02D 41/3005 323/222
4,729,056 A * 3/1988 Edwards ..... F02D 41/20 361/153
6,031,707 A * 2/2000 Meyer ..... F02D 41/20 361/153
6,577,488 B1 * 6/2003 Seifert ..... F02D 41/20 361/156

FOREIGN PATENT DOCUMENTS

JP 4343380 10/2009

* cited by examiner

*Primary Examiner* — Stephen W Jackson
(74) *Attorney, Agent, or Firm* — Rankin, Hill & Clark LLP

(57) ABSTRACT

A voltage limiting circuit of a solenoid drive device includes a function to limit the value of a boost voltage generated by a boost voltage power source circuit. The voltage limiting circuit is equipped with a boost voltage comparing unit and a boost voltage discharge unit. The boost voltage comparing unit compares a voltage-divided value of the boost voltage with a reference voltage value, and in the case that the voltage-divided value is higher than the reference voltage value, the boost voltage discharge unit lowers the voltage-divided value to be less than or equal to the reference voltage value.

4 Claims, 3 Drawing Sheets

SOLENOID DRIVE DEVICE

CROSS-REFERENCE TO RELATED APPLICATION

This application is based upon and claims the benefit of priority from Japanese Patent Application No. 2015-025914 filed on Feb. 13, 2015, the contents of which are incorporated herein by reference.

BACKGROUND OF THE INVENTION

Field of the Invention

The present invention relates to a solenoid drive device which drives a solenoid that acts as an inductance load.

Description of the Related Art

With a fuel injection device (injector) that injects fuel directly into the interior of a cylinder of an engine, a valve-open state of the injector is brought about by imposing a high voltage on a solenoid, which acts as an inductance load, and causing a large electric current to flow therein, and thereafter, the valve-open state is maintained by having a small holding electric current flow to the solenoid. In this case, a power source voltage is boosted and a high voltage (boost voltage) is generated by a boost voltage power source means such as a DC-DC converter or the like, and the injector is placed in a valve-open state by applying the boost voltage to the solenoid.

In Japanese Patent No. 4343380, there is disclosed the feature of limiting a value of the boost voltage (voltage value of a capacitor) to be less than or equal to a predetermined voltage value, by connecting a constant voltage diode as a voltage limiting means in parallel with respect to a high voltage charging capacitor that makes up the DC-DC converter.

SUMMARY OF THE INVENTION

However, when such a constant voltage diode is used, the constant voltage diode itself produces heat during limiting of the boost voltage. Consequently, the voltage accuracy of the constant voltage diode deteriorates when the value of the boost voltage is limited. As a result, the value of the boost voltage applied to the solenoid tends to vary, and there is a possibility for a variance to occur in the fuel injection amount that is injected into the interior of the cylinder from the injector.

The present invention has been devised while taking into consideration the aforementioned problems, and has the object of providing a solenoid drive device that is capable of suppressing a variance in the value of the boost voltage due to heat.

The present invention relates to a solenoid drive device comprising a solenoid drive unit configured to drive a solenoid, a boost voltage power source unit configured to generate a boost voltage by boosting a power source voltage supplied to the solenoid drive unit, a regenerating unit configured to regenerate in the boost voltage power source unit regenerative energy generated by the solenoid when the solenoid drive unit is turned OFF, and a boost voltage limiting unit configured to limit a value of the boost voltage to be less than or equal to a predetermined voltage value.

In addition, for achieving the aforementioned object, in the solenoid drive device, the boost voltage limiting unit further comprises a boost voltage comparing unit configured to compare the value of the boost voltage with the predetermined voltage value, and a boost voltage discharge unit configured to reduce the value of the boost voltage, in a case that the boost voltage comparing unit determines that the value of the boost voltage is higher than the predetermined voltage value.

With the boost voltage power source unit, an excessively boosted voltage is produced, caused by regeneration of regenerative energy to the boost voltage power source unit from the solenoid by the regenerating unit. The boost voltage limiting unit limits the value of the boost voltage, which has been excessively boosted in voltage, to be less than or equal to the predetermined voltage value. In this case, the boost voltage discharge unit is responsible for the function of limiting the value of the boost voltage, and generates heat when limiting the voltage.

Thus, according to the present invention, the boost voltage comparing unit that compares the value of the boost voltage with the predetermined voltage value, and the boost voltage discharge unit are disposed separately from one another. Consequently, the influence of heat on the boost voltage comparing unit from the boost voltage discharge unit is suppressed, and the process to determine the value of the boost voltage in the boost voltage comparing unit can be carried out with high accuracy.

As a result, with the present invention, it is possible to suppress a variance in the value of the boost voltage caused by heat. Further, a layout of the circuit configuration is made possible so as to suppress the influence of heat on the boost voltage comparing unit.

Further, in the present invention, the term "solenoid" includes the meaning of various types of solenoids, such as the solenoid of the above-described injector, and a solenoid of a fuel pump that supplies fuel to the injector, etc. Accordingly, the solenoid drive device according to the present invention is not limited to a drive control device for an injector and a fuel pump, and is capable of being applied to a drive control device for driving various types of solenoids.

Incidentally, according to Japanese Patent No. 4343380, a means for limiting the electric current value is not disposed in the path between ground, and the capacitor and the constant voltage diode. Therefore, when the boost voltage is limited, the waveform of the discharge electric current that flows from the capacitor becomes steep, and there is a concern that the capacitor will become deteriorated to cause a decrease in the capacitance value thereof or the like.

Thus, in the present invention, the boost voltage discharge unit further comprises a switching unit configured to be switched ON or OFF based on a judgment result of the boost voltage comparing unit, and a current limiting resistance device configured to limit a discharge current that flows in the boost voltage power source unit when the switching unit is switched ON. Since the value of the discharge current is suppressed by the current limiting resistance device, and the waveform of the discharge current is prevented from becoming steep, deterioration of the capacitor can effectively be prevented.

Further, if the current limiting resistance device is constituted by being divided into a plurality of resistors, it is possible for the power consumed by the current limiting resistance device to be divided among the respective resistors. By this feature, the resistance value and the rated power of the respective resistors can be reduced.

Furthermore, if the plural resistors are connected in series, it becomes easy for the respective resistors to be laid out on a substrate.

The above and other objects, features and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

A preferred embodiment of a solenoid drive device according to the present invention will be described in detail below with reference to the accompanying drawings.

Figure 1:
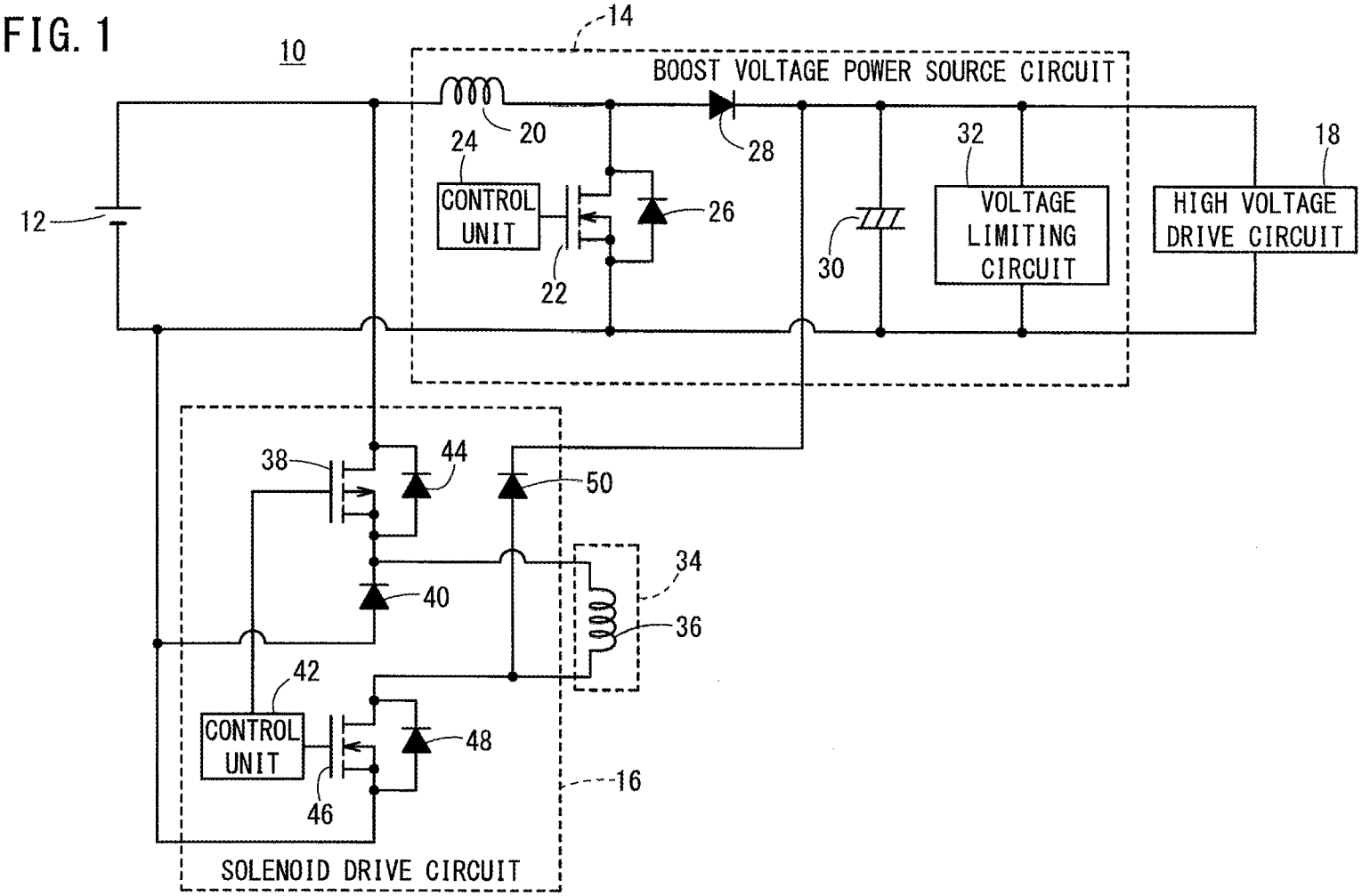
FIG. 1 is a circuit diagram of a solenoid drive device according to an embodiment of the present invention.

As shown in FIG. 1, a solenoid drive device 10 according to the present embodiment can be applied, for example, to a drive control device for a direct injection type of injector that injects fuel directly into the cylinder of an engine, and a drive control device for a fuel pump that supplies fuel to the aforementioned injector. More specifically, the solenoid drive device 10 includes a boost voltage power source circuit (boost voltage power source unit) 14 and a solenoid drive circuit (solenoid drive unit) 16, which are connected in parallel with respect to a battery 12 of a vehicle.

The boost voltage power source circuit 14 generates a high voltage (boost voltage) by boosting the power source voltage of the battery 12, and operates a high voltage drive circuit 18 by supplying the generated boost voltage to the high voltage drive circuit 18 of an injector or the like.

More specifically, in the boost voltage power source circuit 14, one end of a coil 20 is connected to a positive electrode of the battery 12, whereas the other end of the coil 20 is connected to the drain terminal of an N-channel enhancement mode MOSFET 22. The source terminal of the MOSFET 22 is connected to a negative (ground) electrode of the battery 12. The gate terminal of the MOSFET 22 is connected to a control unit 24. A parasitic diode 26 is formed between the drain terminal and the source terminal of the MOSFET 22.

A series circuit made up of a diode 28 and a capacitor 30 is connected in parallel with respect to the MOSFET 22. More specifically, an anode terminal of the diode 28 is connected to the other end of the coil 20 and to a drain terminal of the MOSFET 22. A cathode terminal of the diode 28 is connected to the capacitor 30, which is an electrolytic capacitor. To the high voltage charging capacitor 30 that produces the boost voltage, there are connected in parallel a voltage limiting circuit (voltage limiting unit) 32 and the high voltage drive circuit 18.

On the other hand, by the solenoid drive circuit 16 applying the power source voltage of the battery 12 to a solenoid 36 of a fuel pump 34, the solenoid 36 is driven as an inductance load.

In greater detail, with the solenoid drive circuit 16, a series circuit made up of a P-channel enhanced mode MOSFET 38 and a diode 40 is connected in parallel with respect to the battery 12. More specifically, a drain terminal of the MOSFET 38 is connected to a positive electrode of the battery 12, a source terminal of the MOSFET 38 and a cathode terminal of the diode 40 are connected to each other, and an anode terminal of the diode 40 is connected to a negative electrode of the battery 12. A gate terminal of the MOSFET 38 is connected to a control unit 42, and a parasitic diode 44 is formed between the drain terminal and the source terminal of the MOSFET 38.

One end of the solenoid 36 is connected between the source terminal of the MOSFET 38 and the cathode terminal of the diode 40. The other end of the solenoid 36 is connected to the negative electrode of the battery 12 through an N-channel enhanced mode MOSFET 46. More specifically, a drain terminal of the MOSFET 46 is connected to the other end of the solenoid 36, a source terminal of the MOSFET 46 is connected to the negative electrode of the battery 12, and a parasitic diode 48 is formed between the drain terminal and the source terminal of the MOSFET 46. The gate terminal of the MOSFET 46 is connected to the control unit 42.

An anode terminal of a diode (regenerating unit) 50 is connected between the other end of the solenoid 36 and the drain terminal of the MOSFET 46, and a cathode terminal of the diode 50 is connected between the capacitor 30 and the cathode terminal of the diode 28 that makes up the boost voltage power source circuit 14.

Figure 2:
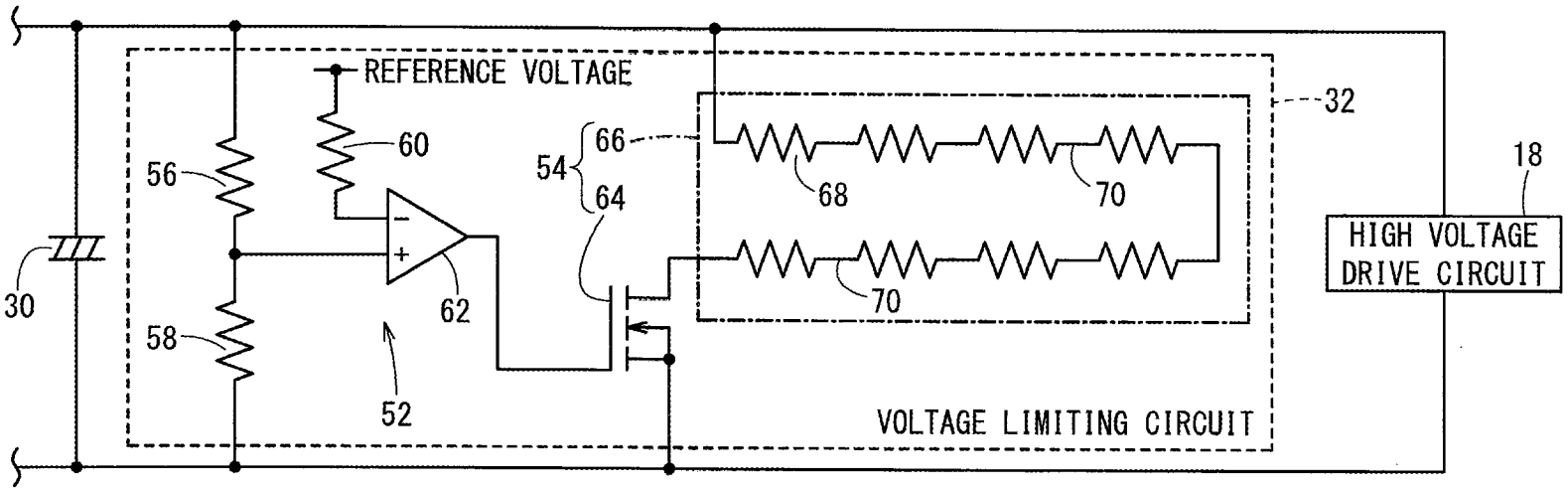
FIG. 2 is a circuit diagram of a voltage limiting circuit shown in FIG. 1.

The voltage limiting circuit 32 is a boost voltage limiting unit for limiting the value of the boost voltage, and as shown in FIG. 2, includes a boost voltage comparing unit 52 and a boost voltage discharge unit 54.

The boost voltage comparing unit 52 includes three resistors 56 through 60 and a comparator 62. A series circuit made up of two of the resistors 56, 58 is connected in parallel with respect to the capacitor 30. A non-inverting input terminal (+ sign input terminal) of the comparator 62 is connected to a point of connection between the two resistors 56, 58, and an inverting input terminal (− sign input terminal) of the comparator 62 is connected to the resistor 60.

In this case, a boost voltage, which is voltage-divided by the two resistors 56 and 58, is supplied to the non-inverting input terminal of the comparator 62, whereas a reference voltage is supplied through the resistor 60 to the inverting input terminal. An output terminal of the comparator 62 is connected to a gate terminal of a MOSFET (switching unit) 64 that makes up the boost voltage discharge unit 54.

The boost voltage discharge unit 54 includes an N-channel enhanced mode MOSFET 64 and a current limiting resistance device 66. In this case, a series circuit made up of the MOSFET 64 and the current limiting resistance device 66 is connected in parallel with respect to the capacitor 30, a series circuit made up of the two resistors 56, 58, and to the high voltage drive circuit 18.

More specifically, one end of the current limiting resistance device 66 is connected with respect to one end of the capacitor 30 and the high voltage drive circuit 18, as well as to the resistor 56. The other end of the current limiting resistance device 66 is connected to the drain terminal of the MOSFET 64. The source terminal of the MOSFET 64 is connected to the other end of the capacitor 30 and the high voltage drive circuit 18, as well as to the resistor 58.

The current limiting resistance device 66 is constituted by connecting a plurality of resistors 68 together in series. More specifically, the current limiting resistance device 66 is constructed by connecting the individual plural resistors 68 in series using wirings 70. As one example thereof, as shown in FIG. 2, a case is shown in which the current limiting resistance device 66 is constructed by connecting eight resistors 68 in series using nine wirings 70.

The solenoid drive device 10 according to the present embodiment is constructed basically as described above. Next, with reference to FIGS. 1 and 2, a description will be given concerning operations of the solenoid drive device 10. In this case, operations of the boost voltage power source circuit 14, the solenoid drive circuit 16, the diode 50, and the voltage limiting circuit 32 of the solenoid drive device 10 will be described, respectively.

First, operations of the boost voltage power source circuit 14 will be described.

When the control unit 24 supplies a gate signal to the gate terminal of the MOSFET 22, a junction between the drain terminal and the source terminal of the MOSFET 22 is switched from OFF to ON. Consequently, electrical current flows from the positive electrode of the battery 12 to the negative electrode of the battery 12 through the coil 20 and the MOSFET 22.

Next, when the MOSFET 22 is switched OFF by the control unit 24 by stopping supply of the gate signal, the current that had flowed in the coil 20 flows to the capacitor 30 through the diode 28, and charges the capacitor 30. Consequently, a high voltage (boost voltage) in which the power source voltage of the battery 12 is boosted is generated in the capacitor 30. The generated boost voltage is applied to the high voltage drive circuit 18, for example, and drives the solenoid that constitutes an injector as the high voltage drive circuit 18.

By the control unit 24 performing a PWM control, for example, which changes the value of the boost voltage by adjusting the pulse width of a pulse signal as the gate signal, a boost voltage of a desired value and duration is applied to the high voltage drive circuit 18 from the boost voltage power source circuit 14, thereby enabling the solenoid of the injector to be driven. Further, by the control unit 24 performing the PWM control, a pulse voltage (boost voltage) of a fixed value and fixed width is applied repeatedly to the high voltage drive circuit 18 from the boost voltage power source circuit 14, whereby the driven state of the solenoid can be maintained.

Next, operations of the solenoid drive circuit 16 will be described.

When the control unit 42 supplies gate signals respectively to the gate terminals of the MOSFET 38 and the MOSFET 46, junctions between the drain terminals and the source terminals of the MOSFETs 38, 46 are both switched from OFF to ON. Consequently, electrical current flows from the positive electrode of the battery 12 to the negative electrode of the battery 12 through the MOSFET 38, the solenoid 36, and the MOSFET 46. As a result, since the power source voltage of the battery 12 is applied to the solenoid 36, the fuel pump 34 is driven, and fuel can be supplied to the injector.

Moreover, when supply of the gate signals to the gate terminals of the MOSFETs 38, 46 from the control unit 42 is stopped, the MOSFETs 38, 46 are switched OFF, respectively, whereupon driving of the solenoid 36 is halted. Further, for example, with the control unit 42, in a condition in which the MOSFET 46 is switched ON, a pulse of a fixed width is supplied repeatedly as a gate signal to the MOSFET 38, whereby ON and OFF states of the MOSFET 38 are repeatedly carried out, and the solenoid 36 can be driven at a predetermined current.

Further, in the case that the MOSFET 38 is repeatedly switched ON and OFF at the time that the MOSFET 46 is in an ON state, a surge voltage is generated in the solenoid 36, and an electrical current caused by the surge voltage is commutated to one end from the other end of the solenoid 36, through the MOSFET 46, the negative electrode of the battery 12, and the diode 40. In this case, since the period at which the MOSFET 38 is switched ON and OFF is short, the commutation energy can be reduced.

Next, operations of the diode 50 as a regenerating unit will be described.

When supply of the gate signals to the gate terminals of the MOSFETs 38, 46 from the control unit 42 is stopped and the MOSFETs 38, 46 are switched OFF, a surge voltage is generated in the solenoid 36, and an electrical current flows from the other end of the solenoid 36 to the positive electrode side of the capacitor 30 through the diode 50. The electrical current is a regenerating current that flows in order to generate in the capacitor 30 a regenerative energy (causing the surge voltage) that has accumulated in the solenoid 36, which in turn flows from the other end of the solenoid 36 to the one end of the solenoid 36 through the diode 50, the capacitor 30, the negative electrode of the battery 12, and the diode 40. As a result, by the regenerating current, which has flowed in from the solenoid 36 as an inductance load, the regenerative energy of the solenoid 36 is accumulated and stored in the capacitor 30.

Next, operations of the voltage limiting circuit 32 as a boost voltage limiting unit will be described.

As discussed previously, a regenerating current flows to the capacitor 30 from the solenoid 36, and by regenerative energy of the solenoid 36 being accumulated and stored in the capacitor 30, an excessively boosted voltage is generated by the boost voltage power source circuit 14. Thus, there is a need for limiting the value of the boost voltage, which has become excessive, to be less than or equal to a predetermined voltage value.

Conventionally, for example as disclosed in Japanese Patent No. 4343380, the value of the boost voltage is limited to being less than or equal to a predetermined voltage value, by a constant voltage diode being connected in parallel with respect to a capacitor. However, when the constant voltage diode is used, the constant voltage diode itself produces heat during limiting of the boost voltage. Consequently, the voltage accuracy of the constant voltage diode deteriorates when the value of the boost voltage is limited. As a result, the value of the boost voltage applied to the high voltage drive circuit tends to vary, and there is a possibility for a variance to occur in the fuel injection amount that is injected into the interior of the cylinder from the injector.

Thus, with the solenoid drive device 10 according to the present embodiment, as shown in FIGS. 1 and 2, the voltage limiting circuit 32 is connected in parallel with the capacitor 30.

In this case, the boost voltage is voltage-divided by the two resistors 56, 58, and after such voltage division, the boost voltage is supplied to the non-inverting input terminal of the comparator 62 of the boost voltage comparing unit 52. The comparator 62 compares the value (voltage-divided value) of the boost voltage after division thereof, with the value (reference voltage value corresponding to the predetermined voltage value) of the reference voltage that is input to the inverting input terminal through the resistor 60.

More specifically, in the case that the voltage-divided value is less than or equal to the reference voltage value, the comparator 62 outputs from the output terminal a substantially zero (0) level signal (low level signal), whereas, in the case that the voltage-divided value exceeds the reference voltage value, the comparator 62 outputs a high level signal from the output terminal. Stated otherwise, the comparator 62 compares the voltage-divided value with the reference voltage value, and if it is determined that the voltage-divided value is higher than the reference voltage value, the high level signal is supplied to the gate terminal of the MOSFET 64.

In the case that the low level signal is supplied to the gate terminal from the output terminal of the comparator 62, the MOSFET 64 of the boost voltage discharge unit 54 maintains the OFF state between the drain terminal and the source terminal, whereas, in the case that the high level signal is supplied to the gate terminal from the output terminal, the MOSFET 64 turns ON the junction between the drain terminal and the source terminal.

Consequently, if the MOSFET 64 is ON, the other terminal of the current limiting resistance device 66 is connected through the MOSFET 64 to the negative electrode of the capacitor 30. As a result, the energy accumulated and stored in the capacitor 30 is discharged as a discharge current that flows from the positive terminal of the capacitor 30, through the current limiting resistance device 66, and the MOSFET 64, and to the negative terminal of the capacitor 30.

In this case, because the current limiting resistance device 66 is disposed in the path through which the discharge current flows, the value of the discharge current can be suppressed, and the waveform of the discharge current can be prevented from becoming steep.

The comparator 62 is capable of monitoring at all times the value of the boost voltage. Therefore, by discharging the energy accumulated and stored in the capacitor 30, in the event that the voltage-divided value is less than or equal to the reference voltage value, the low level signal is output from the output terminal. Consequently, the MOSFET 64 switches from ON to OFF, and the discharging operation of the capacitor 30 can be stopped.

As has been described above, in accordance with the solenoid drive device 10 according to the present embodiment, the voltage limiting circuit 32 further comprises the boost voltage comparing unit 52 for comparing the (voltage-divided value of the) value of the boost voltage with the (reference voltage value corresponding to the) predetermined voltage value, and the boost voltage discharge unit 54 for reducing the value of the boost voltage, in the case that the boost voltage comparing unit 52 has determined that the voltage-divided value is higher than the reference voltage value.

Due to the regenerative energy that is regenerated from the solenoid 36 into the boost voltage power source circuit 14 through the diode 50, an excessively boosted voltage is produced by the boost voltage power source circuit 14. The voltage limiting circuit 32 limits the value of the boost voltage, which has been excessively boosted in voltage, to be less than or equal to the predetermined voltage value. In this case, the boost voltage discharge unit 54 is responsible for the function of limiting the value of the boost voltage, and generates heat when limiting the voltage.

According to the present embodiment, the boost voltage comparing unit 52 that compares the voltage-divided value of the boost voltage with the reference voltage value, and the boost voltage discharge unit 54 are disposed separately from one another. Consequently, the influence of heat on the boost voltage comparing unit 52 from the boost voltage discharge unit 54 is suppressed, and the process to determine the value of the boost voltage in the boost voltage comparing unit 52 can be carried out with high accuracy.

As a result, with the present embodiment, it is possible to suppress a variance in the value of the boost voltage caused by heat. Further, a layout of the circuit configuration is made possible so as to suppress the influence of heat on the boost voltage comparing unit 52.

Incidentally, according to Japanese Patent No. 4343380, a unit for limiting the current value is not disposed in the path between ground, and the capacitor and the constant voltage diode. Therefore, when the boost voltage is limited, the waveform of the discharge current that flows from the capacitor becomes steep, and there is a concern that the capacitor will become deteriorated to cause a decrease in the capacitance value thereof or the like.

Thus, in the present embodiment, the boost voltage discharge unit 54 further comprises the MOSFET 64, which is switched ON or OFF based on a judgment result of the boost voltage comparing unit 52, and the current limiting resistance device 66 that limits the discharge current that flows when the MOSFET 64 is turned ON. Since the value of the discharge current is suppressed by the current limiting resistance device 66, and the waveform of the discharge current can be prevented from becoming steep, deterioration of the capacitor 30 can effectively be prevented.

Further, the current limiting resistance device 66 is constituted by being divided into the plurality of resistors 68, whereby it is possible for the power consumed by the current limiting resistance device 66 to be divided among the respective resistors 68. By this feature, the resistance value and the rated power of the respective resistors 68 can be reduced.

Furthermore, by connecting the plural resistors 68 together in series, it becomes easy for the respective resistors 68 to be laid out on a substrate. Concerning this result, a description will be given in greater detail with reference to FIGS. 3A and 3B.

Figure 3A:
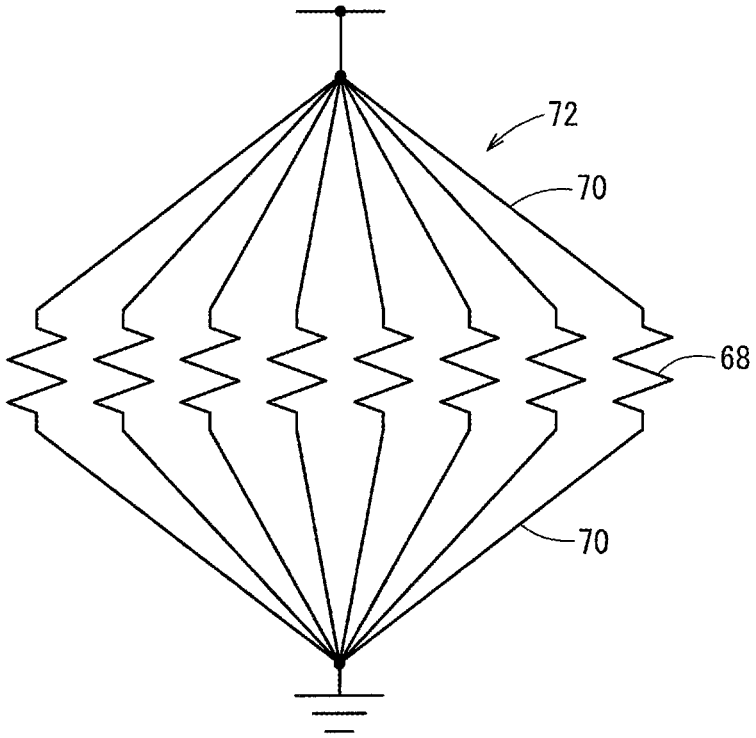
FIG. 3A is a circuit diagram of a case in which respective resistors of a current limiting resistance device are connected in parallel.

FIG. 3A shows a current limiting resistance device 72 according to a comparative example, in which plural resistors 68 are connected in parallel. In this case, eight individual resistors 68 of the current limiting resistance device 72 are connected in parallel, and therefore, there is a need for sixteen wirings 70 in total made up of eight on one end side, and eight on the other end side of the current limiting resistance device 72. Consequently, when the respective resistors 68 are laid out on a non-illustrated substrate, it is difficult for the respective resistors 68 to be laid out freely.

Figure 3B:
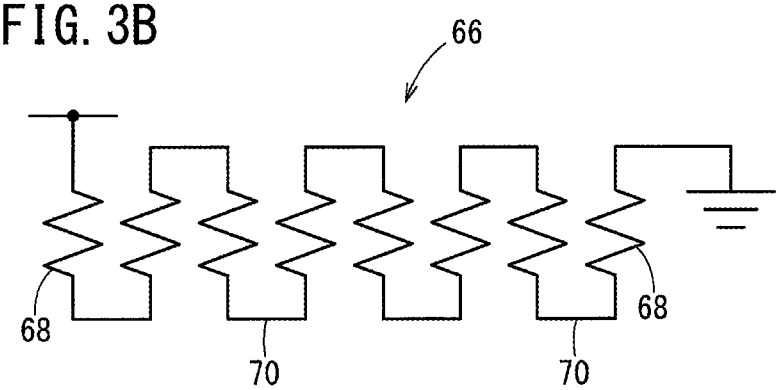
FIG. 3B is a circuit diagram of a case in which respective resistors of a current limiting resistance device are connected in series.

In contrast thereto, in the current limiting resistance device 66 in the present embodiment shown in FIG. 3B, the plural resistors 68 are connected in series. In this case, the current limiting resistance device 66 enables the eight individual resistors 68 to be connected with a total of just nine wirings 70. Consequently, the respective resistors 68 are capable of being laid out freely on the substrate.

The solenoid drive device according to the present invention is not limited to the embodiment described above, and various additional or modified configurations may be adopted therein without deviating from the essence of the present invention.

Above, a case has been described in which, when regenerative energy is regenerated in the capacitor 30 through the diode 50 from the solenoid 36 of the fuel pump 34, the value of the boost voltage is limited by the voltage limiting circuit 32. However, the present embodiment is not limited to the above description, and even in the case that regenerative energy is regenerated in the capacitor 30 through a non-illustrated diode from the solenoid of an injector, the value of the boost voltage can similarly be limited by the voltage limiting circuit 32. Further, although not illustrated, in the present embodiment, hunting of the boost voltage can be prevented by adding a hysteresis circuit to the comparator 62 of the boost voltage comparing unit 52. Furthermore, the present invention is not limited to a drive control device for a solenoid that constitutes part of the injector and the fuel pump 34, and can be applied to drive control devices used for driving various types of solenoids.

What is claimed is:

1. A solenoid drive device comprising:

a solenoid drive unit configured to drive a solenoid;

a boost voltage power source unit configured to generate a boost voltage by boosting a power source voltage supplied to the solenoid drive unit;

a regenerating unit configured to regenerate in the boost voltage power source unit regenerative energy generated by the solenoid when the solenoid drive unit is turned OFF; and a boost voltage limiting unit configured to limit a value of the boost voltage to be less than or equal to a predetermined voltage value while the regenerative energy is fed to the boost voltage power source unit;

wherein the boost voltage limiting unit further comprises:

a boost voltage comparing unit configured to compare the value of the boost voltage with the predetermined voltage value; and a boost voltage discharge unit configured to reduce the value of the boost voltage, in a case that the boost voltage comparing unit determines that the value of the boost voltage is higher than the predetermined voltage value.

2. The solenoid drive device according to claim 1, wherein the boost voltage discharge unit further comprises:

a switching unit configured to be switched ON or OFF based on a judgment result of the boost voltage comparing unit; and a current limiting resistance device configured to limit a discharge current that flows in the boost voltage power source unit when the switching unit is switched ON.

3. The solenoid drive device according to claim 2, wherein the current limiting resistance device is constituted by being divided into a plurality of resistors.

4. The solenoid valve drive device according to claim 3, wherein the plural resistors are connected in series.

* * * * *